United States Patent [19]

Hasegawa

[11] 3,947,037

[45] Mar. 30, 1976

[54] BOARD GAME APPARATUS

[76] Inventor: Satoshi Hasegawa, 6-506 Keyakidai-danchi, 1-13-2 Wakaba-cho, Tachikawa, Tokyo, Japan

[22] Filed: Jan. 23, 1975

[21] Appl. No.: 543,235

[30] Foreign Application Priority Data

Jan. 31, 1974 Japan ..... 49-13126

[52] U.S. Cl. ..... 273/131 D; 273/131 K; 273/137 R

[51] Int. Cl.[2] ..... A63F 3/00

[58] Field of Search ..... 273/131, 137

[56] References Cited

UNITED STATES PATENTS

| | | | |
|---|---|---|---|
| 3,759,523 | 9/1973 | Randolph | 273/137 R |
| 3,791,648 | 2/1974 | Patterson | 273/131 AB |
| D231,847 | 6/1874 | Tchou | 273/131 K X |

FOREIGN PATENTS OR APPLICATIONS

| | | | |
|---|---|---|---|
| 327,504 | 3/1903 | France | 273/131 AB |
| 141,915 | 3/1931 | Switzerland | 273/131 K |
| 1,235,773 | 5/1960 | France | 273/131 D |

*Primary Examiner*—Delbert B. Lowe
*Attorney, Agent, or Firm*—George B. Oujevolk

[57] ABSTRACT

A set of implements for a go type of game comprises in combination a board having nine rows and ten columns forming squares and marginal columns and rows which are distinguished from the others and a pair of sets of a same number of black and white pieces all shaped in an identical cylindroid shape and each having a distinguishing circular mark at one end, whereby one may enjoy playing a match with moderate reasoning powers challenged by complex developments of the face of the board.

1 Claim, 10 Drawing Figures fig-5
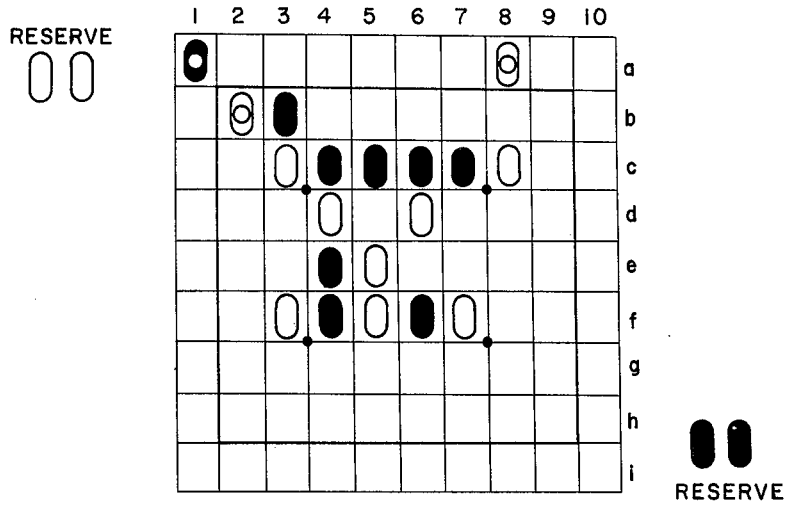
fig-6
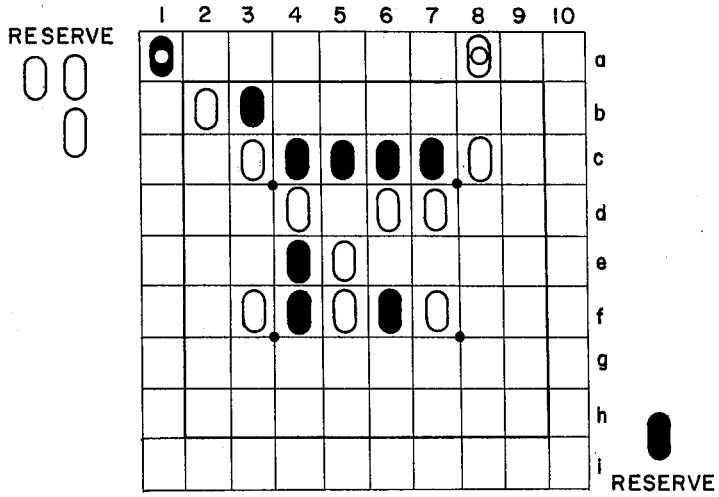
fig-7
| MATCH \ NAME | A | B |
|---|---|---|
| 1 | X | (1) |
| 2 | (0) | X |
| TOTAL | 0 | 1 |

BOARD GAME APPARATUS

DETAILED DESCRIPTION OF THE INVENTION:

1. Background of the Invention

This invention relates to a set of indoor game implements comprising a board with nine rows and ten columns of squares and cylindroidal black and white pieces, and particularly a set of pieces used for an interesting fast moving game in which mobility is imparted to the pieces and an arrangement of five-piece series is competed for between two players.

2. Description of the Prior Art

Many indoor games using pieces have been long known, such as go games; the go game has the disadvantage that it may be not easily played in that it involves such difficult rules as to require substantial reasoning powers of players and a rather long time before it is played out. The go-bang game does not need reasoning powers as required in playing the go game, but involves so simple rules as to make it unappealing.

3. The Object of the Invention

The object of this invention is to provide a novel set of implements used for a modern-style fast moving game which may be played for a short time and on any occasion by any unqualified persons with normal reasoning powers instead of "deep" inference otherwise required by complex rules.

BRIEF DESCRIPTION OF THE DRAWINGS

FIGS. 3 to 6 are diagrams showing the face of the board in steps during one game match;

FIG. 7 shows judgement of a decision of a game match;

DETAILED DESCRIPTION OF THE EMBODIMENT

A set of game implements embodied by this invention comprises in combination a checker board 1 having nine rows and 10 columns of squares, marginal columns and rows being set off with a marginal line or having a different color so as to be distinguished from the others, and a pair of sets of black and white pieces 2A and 2B each in the number of twelve and all having an identical cylindroidal shape. Circular marks 3A and 3B, which may represent a crown, attached at the one end of each of the black and the white pieces, respectively.

Figure 1:
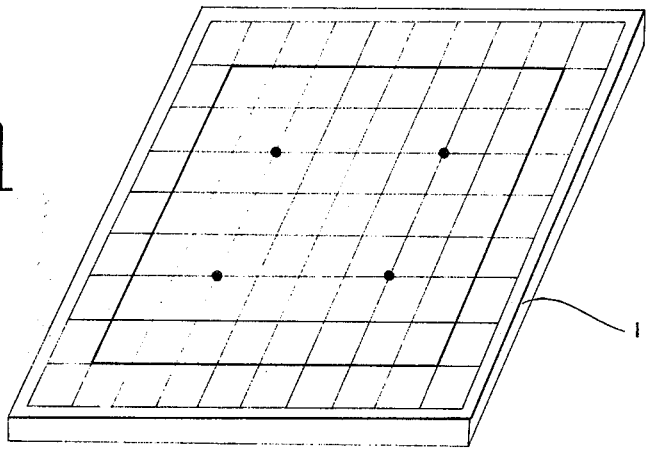
FIG. 1 is a perspective view of a board of one embodiment of this invention.
Figure 2:
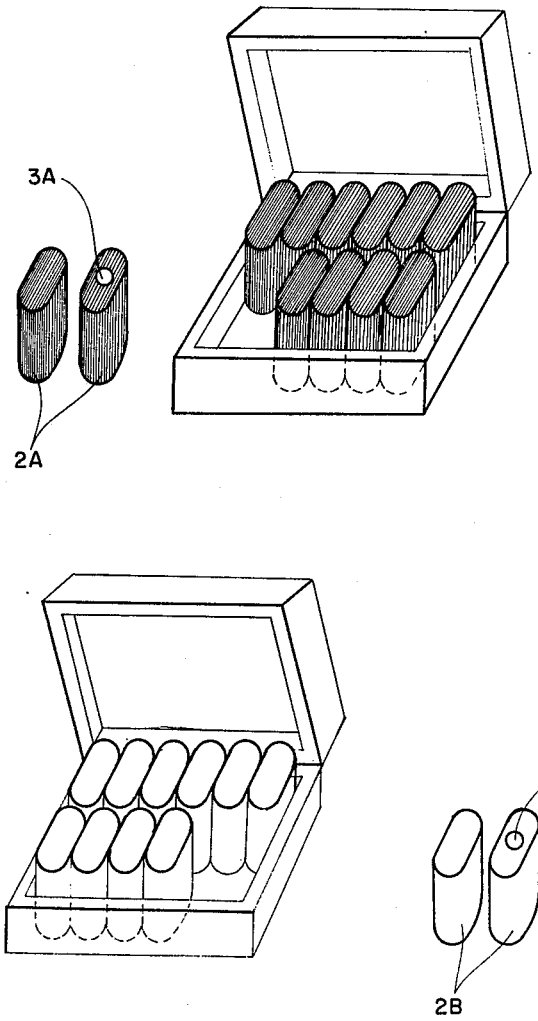
FIG. 2 is a perspective view of pieces thereof.
Figure 3:
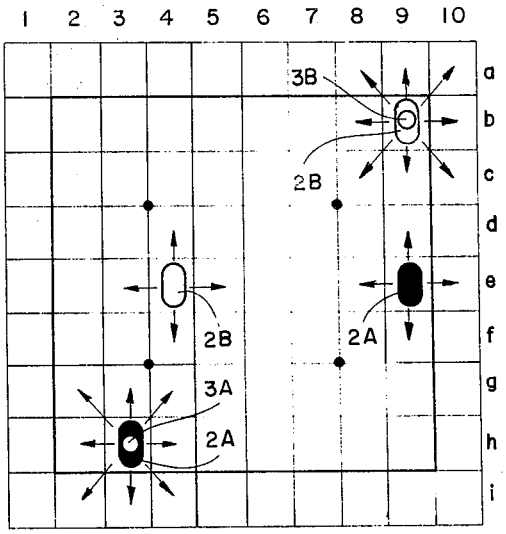

Referring now to the game for which the above described implements are used, the rules of the game are as follows;

1. The 12 pieces are available to each of two players.
2. The player of the black pieces shall have the first turn.
3. Any pieces placed on the board may be moved into any adjacent square in the longitudinal or crosswise direction per one move (see FIG. 3).
4. The players shall alternately take turns during the game, and each player may take his turn by moving one of his own pieces already placed on the board, or by placing a piece from his reserve.
5. Any piece directly placed or subsequently moved into one of the distinguished marginal squares is to be crowned by being placed upside down so that the marked end portion of the black or white piece may face upwards.

Figure 8:
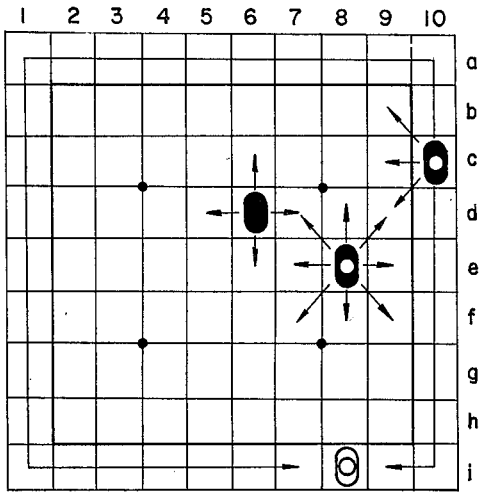
FIGS. 8 to 10 are diagrams showing the face of the board in steps during another game match.

6. Any crowned pieces may be moved into an adjacent square in any of the longitudinal, crosswise and diagonal directions (see FIG. 3).
7. The winner is the first player who places or arranges for placing 5 pieces in a side by side series in any longitudinal, crosswise or diagonal direction.
8. In addition to the move range of a crowned piece provided for in item (6), any crowned piece positioned in one of the distinguished marginal squares, which should be called the Outer Space, may be skipped or jumped over to any other square of the Outer Space. Any crowned piece may not advance beyond the other pieces placed or moved by one of the other players in one square of the Outer Space (see FIG. 8). This rule is optional.

Figure 4:
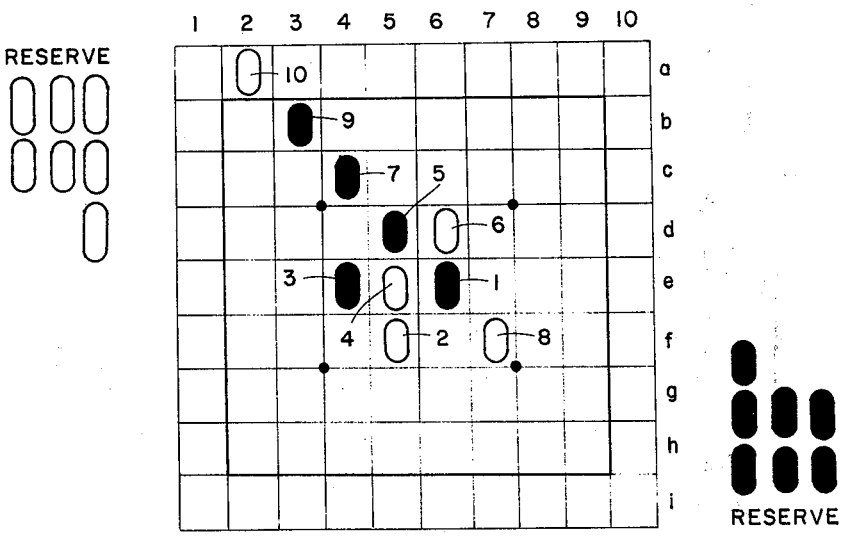

Two matches are played with the players taking alternately the first turn, namely, the black pieces. Suppose that the board has the face shown in FIG. 4 in the course of the first match. The one player of the black pieces is to take the next turn on that face. If a black piece is placed in square 4*d*, this will allow the other player, of the white pieces, to place his piece in square 4*f* and thus to arrange simultaneously a pair of open three-piece series so that the black would lose the match, i.e., five pieces will be placed side by side in the next few moves and there is no way for black to avoid this. In order to prevent creation of the pair of open three-piece series, the black should place his piece for example in square 6*c*. Then the board face is arranged, for example, as shown in FIG. 5 or FIG. 6 through the steps of placement of white in square 3*f*, black in 4*f*, white in 4*d*, black in 7*b*, white in 8*a*, black in 5*c* (by upward move), white in 3*c*, black in 7*c* (by downward move), white in 8*c*, black in 6*f* (by downward move), white in 2*b* (by downward move) and black in 1*a*. On this board face the white takes the next turn and placement of white in square 7*d* will cause a simultaneous arrangement of a pair of open three-piece series which can not be prevented by any move or placement of blacks. This means that the white player wins the match with one piece in reserve, which is to be termed a 1 alpha win of the white. Although three pieces then remain also in reserve of the black, such a reserve of the loser is not to be considered in judgement on the decision of the match.

In the second match the other player takes the black pieces and the first player the white pieces. Suppose that the white player wins the second match without any piece remaining in his reserve. Then, the first and second matches were won by the two players, respectively. The judgement shows, however, that the player who won the first match with one piece in reserve is to be the winner of the game (see FIG. 7).

Whereas the foregoing steps of the game are based on the combination of rules 1) to 7), exclusive of 8), a variation of the game including rule (8) will be now described.

Figure 9:
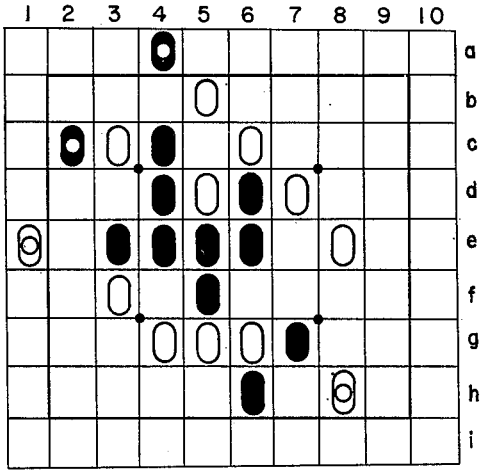
Figure 10:
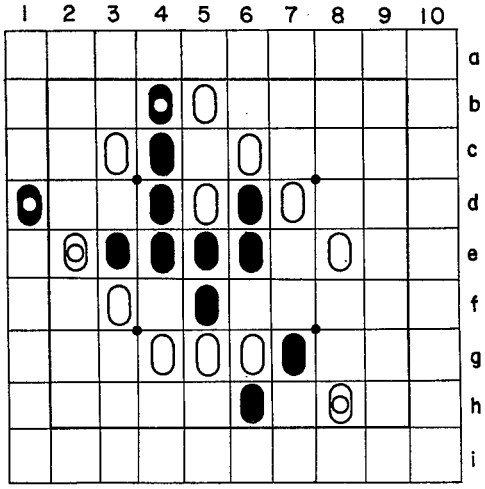

Suppose that the final board pace is arranged as shown in FIG. 9 when both players have exhausted their reserved pieces. The black will have the next turn. It is predictable that the white would take the moves of white from 8*h* into 9*g* and then 9*f* and it is essential for the black to make a set of moves of a smaller number than that of the white required to achieve a winning arrangement. For instant, black moves from 2*c* to 1*d*, white from 1*e* to 2*e*, and black from 4*a* to 4*b*, and the board face of FIG. 10 is arranged so that black can not be prevented from moving from 1*d* to 4*a* by any move of whites, this meaning that the black player wins the match.

Thus, the addition of rule (8) that any crowned piece placed within the Outer Space may jump over any square of the Outer Space may provide more variation of the progress of the game, which may challenge the players' reasoning powers.

Referring to the components of the game set of this invention, the pieces are shaped as a cylindroid thereby to facilitate manipulation in the course of playing the game and present a neat, favorable appearance. It is interesting that night and daytime are implied by the black and white colors applied to the sets of pieces, respectively, and that the figurative symbols which as a matter of convenience may be red or golden crown marks attached to each of the pieces symbolize the sun and the moon, respectively.

Althrough the game can be easily learned, the board face may be developed in a complex, dynamic manner due to mobility and crowning of the pieces, as opposed to static developments of other games, which may challenge and nourish reasoning powers of the players.

An interest in the game may be stimulated by a number of the pieces remaining in reserve at the decision of a match which is to be taken into account for judgement of the game.

Accordingly, the game set of this invention may please every taste of modernity and in particular prompt thinking powers of a school pupil.

What is claimed is:

1. Apparatus for playing a board game of the type using a board having checker-board squares and pieces movable thereon, comprising in combination: a game board having nine rows and ten columns of squares and marginal columns and marginal rows at the outer margins of the board, said marginal columns and rows being visually distinguishable from the others, and a pair of sets of twelve each black and white pieces, all of an identical cylindroid shape, each having a circular mark at one end portion which mark is not normally visible but becomes visible when the piece is inverted.

* * * * *